United States Patent [19]

Fletcher et al.

[11] Patent Number: 4,883,133

[45] Date of Patent: Nov. 28, 1989

[54] COMBUSTION OPERATED DRILLING APPARATUS

[76] Inventors: Gerald L. Fletcher; Gregory T. Fletcher, both of Box 6 KBYCL, Jakarta, Indonesia, 12430

[21] Appl. No.: 261,596

[22] Filed: Oct. 24, 1988

[51] Int. Cl.[4] ..... E21B 4/06; E21B 4/14; E21B 4/16; E21B 10/36

[52] U.S. Cl. ..... 175/93; 175/96; 175/106; 175/414; 175/417; 175/296

[58] Field of Search ..... 175/93, 95, 96, 412, 175/414, 417, 296; 299/85, 94, 79, 88

[56] References Cited

U.S. PATENT DOCUMENTS

| | | | |
|---|---|---|---|
| 900,951 | 10/1908 | Proctor | 175/96 X |
| 1,461,713 | 7/1923 | Gilman et al. | 175/96 |
| 2,400,853 | 5/1946 | Stilley | 175/414 X |
| 2,595,126 | 4/1952 | Causey | 175/96 |
| 2,815,932 | 12/1957 | Wolfram | 175/412 X |
| 2,942,850 | 6/1960 | Heath | 175/96 |
| 3,144,086 | 8/1964 | Kurt et al. | 175/96 |
| 3,870,113 | 3/1975 | Slawson | 175/96 |

*Primary Examiner*—Stephen J. Novosad
*Attorney, Agent, or Firm*—John E. Reilly

[57] ABSTRACT

A percussion drilling apparatus for drilling bore holes into subterranean formation in which a plurality of drill rods are arranged in concentric rows in a drill bit housing, each rod having an impact tooth at its lower ends and the rods arranged either to converge inwardly adjacent to the center of the housing or to diverge outwardly at progressively increased angles in each row toward the outermost row. The impact teeth are fired sequentially by concentric combustion chambers arranged above the drill rods and where the pattern and rate of firing can be controlled by cam operated intake and exhaust valves associated with the combustion chambers. The drill bit housing is arranged at the lower end of the drill string with an umbilical cord which carries all necessary cables and lines between the surface controls and the drill bit housing for the purpose of controlling combustion in each chamber and of carrying away the cuttings as the drilling operation proceeds.

20 Claims, 5 Drawing Sheets

COMBUSTION OPERATED DRILLING APPARATUS

Specification

This invention relates to percussion drilling apparatus; and more particularly relates to a novel and improved downhole drilling apparatus for boring earth, rock or other hard substances in a reliable and highly efficient manner.

BACKGROUND AND FIELD OF INVENTION

Numerous approaches have been taken in the design and construction of percussive drilling apparatus and particularly in the design of bits which employ multiple drilling teeth or drills for downhole drilling operations. Representative of approaches taken in the past is that disclosed in U.S. Letters Pat. No. 2,815,932 to Wolfram wherein a pneumatic hammer drives a generally fan-shaped arrangement of plungers with a pilot cutter positioned centrally of the plungers. Spring return members are employed in association with the plungers but are not in and of themselves capable of fully retracting the plungers after each blow. In U.S. Letter Pat. No. 2,595,126 to Causey, vertically adjustable inner and outer concentric drilling units are employed where one unit works ahead of the other to facilitate drilling a well. U.S. Letters Pat. No. 1,932,891 to Harner employs teeth arranged in fan-shaped rings which are successively reciprocated by pneumatic drive which operate cylinder heads. The arrangement is such that the teeth in one ring are driven between the teeth of another adjacent ring. In U.S. Letters Pat. No. 1,419,980 to Palma, fish-tail type cutting teeth are activated by divergently extending cylinders in cutting across a vertically extending arc. Similarly, in U.S. Letters Pat. No. 1,970,113 to Slawson, pressurized air is employed to drive a series of axially directed teeth; and in U.S. Letters Pat. No. 2,400,853 to Stilly, spring-loaded cutting tools are operated by fluid pressure.

It is proposed in accordance with the present invention to employ combustion chambers concentrically arranged to successively drive a series of teeth at the lower ends of concentric rings of pistons to deliver the necessary force to a series of teeth. The teeth are disposed in circumferentially spaced relation to one another in a series of concentric rows and are successively driven from the innermost to outermost row by sequential firing of the combustion chambers for each row or ring of teeth. Individual teeth are constructed so as to afford optimum wear and efficiency in operation.

SUMMARY OF THE INVENTION

It is an object of the present invention to provide for a novel and improved combustion operated drilling assembly and which is specifically designed for downhole drilling applications.

Another object of the present invention is to employ internal combustion for driving concentric rings of movable teeth in radially outward succession to progressively enlarge a hole to the desired size.

A further object of the present invention is to provide for a novel method and means for sequentially firing successive rings of teeth to chip off portions of a substance to be penetrated into the space evacuated by the chipping action of the teeth of each next adjacent inner ring, the inside to outside chipping action improving the efficiency and speed at which hard substances can be penetrated.

Another object of the present invention is to provide for a novel and improved combustion operated mechanism which is capable of delivering substantial impact force via concentric or annular pistons to successive rings of movable teeth.

A still further object of the present invention is to provide a novel and improved percussive drilling apparatus in which a series of movable teeth are concentrically arranged in a fan-shaped arrangement and set at different predetermined angles to the longitudinal axis of the assembly for most efficient cutting and chipping action; and further wherein a series of combustion chambers are employed in combination with pistons which are successively fired to drive the teeth in such a way as to effect optimum efficiency and speed of penetration of the bit into different substances to be drilled.

A preferred form of the present invention resides in a percussion drill bit apparatus for drilling into subterranean formations and which comprises a drill bit housing mounted at the lower end of a drill string, the housing provided with a central opening therethrough and a plurality of drill rods are concentrically arranged in the housing to extend downwardly through the lower end of the housing, each rod having an impact tooth at its lower end and means for mounting the drill rod for slidable lengthwise reciprocal movement along the longitudinal axes of the drill rods. A series of combustion chambers are arranged in concentric relation to one another above the drill rods, each chamber having at least one fuel intake valve and one exhaust valve, means for delivering a combustible fuel mixture into each of the combustion chambers and igniter means for igniting the mixture when introduced into each chamber. Sequential control means for sequentially opening and closing each of the intake and exhaust valves in a chamber and having firing means which are correlated with the opening of the intake valves to activate the igniter means in coordination with the opening of each valve to sequentially advance the drill rods downwardly from the lower end of the housing into the subterranean formation. Preferably, each combustion chamber has a piston mounted at the lower end and which is operative to drive each drill rod downwardly into the formation, and the drill rods are arranged at different angles of extension away from the housing so as to vary the angle of attack with respect to the formation. In this relation, the lower end of each drill rod is tapered and fitted with an impact tooth which will most effectively penetrate the formation and particularly in regard to hard substances impart a chipping or cutting action. By sequentially firing the rows of drill rods and impact teeth progressively from the innermost to outermost row, cutting progresses in a radial outward direction away from the center to progressively enlarge the hole to the desired size.

The above and other objects, advantages and features of the present invention will become more readily understood and appreciated from a consideration of the following detailed description of a preferred embodiment when taken together with the accompanying drawings in which:

DETAILED DESCRIPTION OF THE PREFERRED EMBODIMENT

Figure 1:
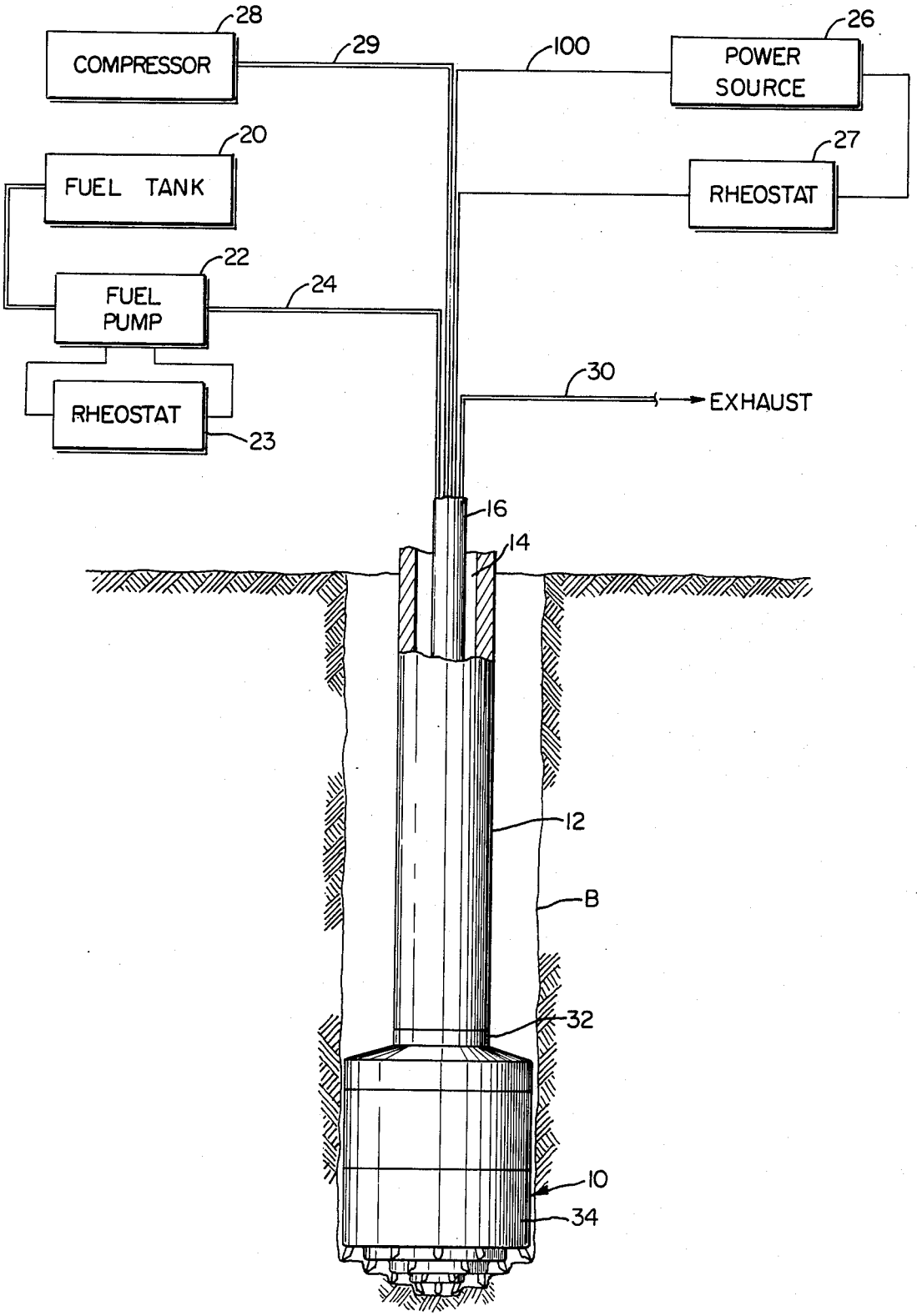
FIG. 1 is a view partially in section of a preferred form of drilling apparatus employed in an earth-boring operation and representing typical controls utilized at the surface for operation of the apparatus.
Figure 2:
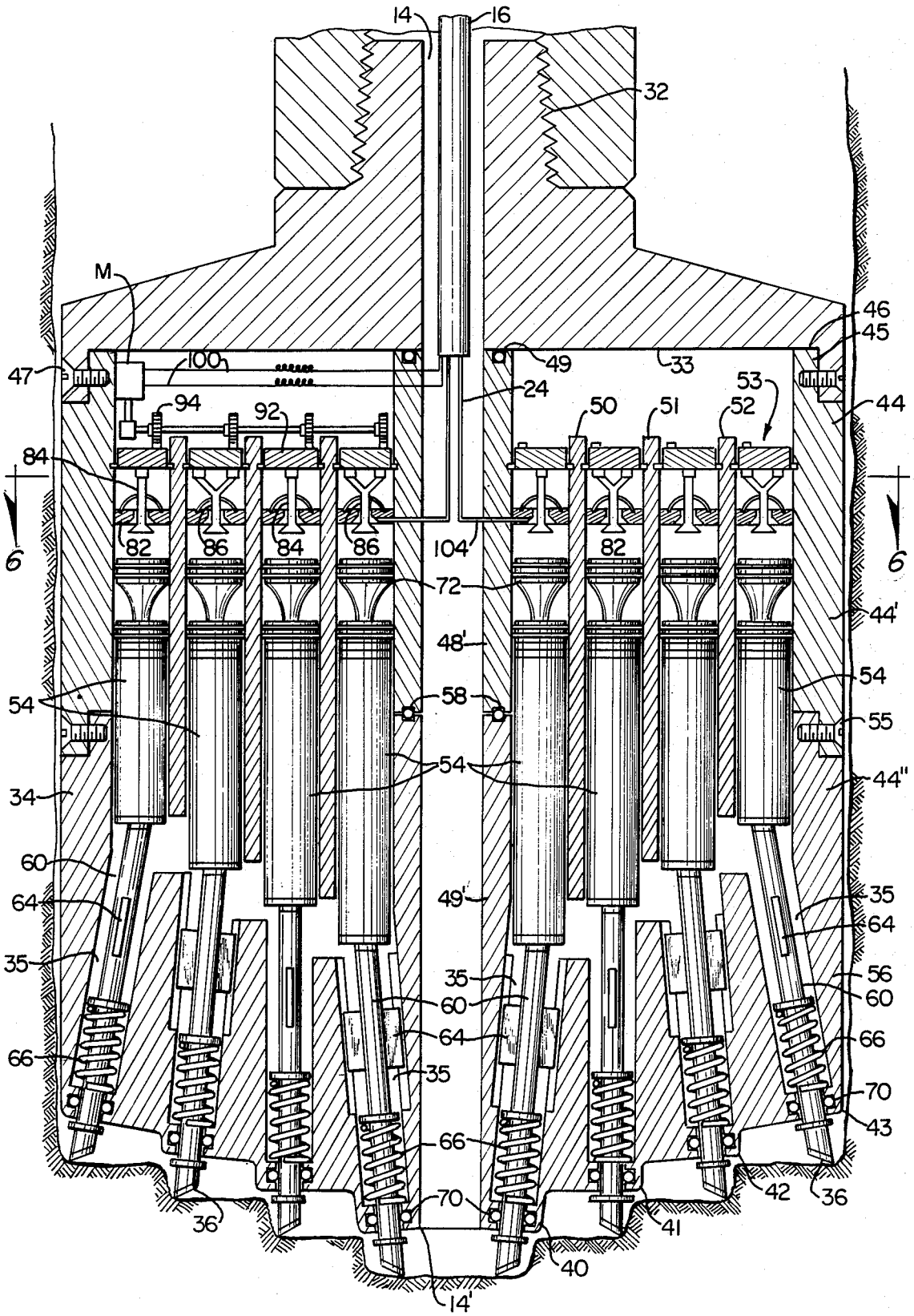
FIG. 2 a sectional view enlarged of a preferred form of drilling apparatus in accordance with the present invention.

Referring to FIGS. 1 and 2 of the drawings, a preferred form of drilling apparatus 10 is illustrated in operative position in forming a bore hole B in a subsurface formation, for instance, in the drilling of a gas or oil well, the drilling apparatus 10 being suspended from a conventional drill string 12. The drill string 12 is of tubular construction and in a well-known manner permits circulation of a drilling fluid through hollow interior 14, and an umbilical cord 16 extends downwardly through the hollow interior 14 of the drill string 12. The umbilical cord may be multi-chambered and of the type commonly used in turbo drilling and similar operations for the purpose of carrying a plurality of electrical cables and circulating lines as indicated from the surface down to the drilling apparatus 10. Typically, the controls at the surface necessary for operation of the drilling operation may for the purpose of illustration consist of a fuel tank 20 and fuel pump 22 with a rheostat control 23 to pump fuel via line 24 to the drilling apparatus. Electrical controls include a suitable power source 26 and rheostat 27 both for driving an electric motor M (see FIG. 5) and for sequentially firing spark plugs S in a manner to be described. A compressor 28 supplies air under pressure via line 29 to the combustion chambers, and an exhaust line 30 is provided as a means of removing spent gases from the combustion chambers.

As noted from FIG. 2, the preferred form of drilling apparatus 10 takes the form of a bit having a tooth housing or body 34 and an upper threaded end or sub 32 for threaded connection to the lower end of the drill stem 12, and the hollow interior 14 of the drill stem extends continuously throughout the length of the body 34 to communicate with the bore hole at its lower exit end 14'.

The housing or body 34 preferably is a solid block of steel or other durable material provided with a series of bores 35 at its lower end arranged to accommodate concentric rows of movable drilling teeth 36 inserted into individual sleeves or liners 37 in each bore 35. In the embodiment shown in FIG. 2, four concentric rows of teeth 36 are provided with an inner row 40 having a series of teeth 36 in circumferentially spaced relation to one another and slanted or cocked radially and inwardly at a low gradual angle with respect to the center axis of the body 34. A second row 41 is provided with teeth arranged along individual axes parallel to the longitudinal axis. In row 42, the teeth 36 are arranged to diverge in a radially downward and outward direction at a low gradual angle away from the longitudinal axis of the body while an outer row 43 of teeth 36 fan outwardly at a slightly greater angle than that of the next outer row 42. For the purpose of illustration but not limitation, the inner row 40 has teeth inclined inwardly at an angle on the order of 10° while in the outer rows 42 and 43 the teeth angle outwardly at angles of 10° and 20°, respectively. Further by way of example, the number of teeth in each row proceeding in a radial outward direction from the inner row 40 is progressively increased so that for example in row 40 there are a series of eight teeth, in row 41 a series of sixteen teeth, in row 42 a series of twenty-four teeth, and in the outermost row 43 a series of thirty-two teeth; however, it will be evident that the number of teeth in each row will vary according to the size of the bit and nature of the formation into which a hole or bore is to be formed.

The upper end of the body 34 has an outer cylindrical wall 44 terminating in an upper reduced end 45 which is connected to a socket end 46 of the sub 32 by lock screws 47. An inner cylindrical wall 48 of the body is held in sealed engagement with the lower surface 33 of the sub 32 as indicated at 49. A plurality of concentric rings 50, 51 and 52 are arranged in equally spaced relationship proceeding outwardly from the inner wall 48 to the outer wall 44 and which define annular combustion chambers to house the activating pistons 54 for each of the rings of movable drilling teeth 36. It will be noted that the outer wall 44 is divided into two sections with an upper section 44' interconnected to the lower section 44'' by locking screws 55; and the lower section 44' includes an outwardly divergent extension or skirt 56 at its lower end which forms a part of the wall surrounding the outermost series of bores 43. Inner wall 48 similarly is divided into upper section 48' and lower section 49' sealed together in end-to-end relation at 58, and the lower end of the wall 49' being tapered to form a part of the housing for the innermost series of bores 40.

Figure 3:
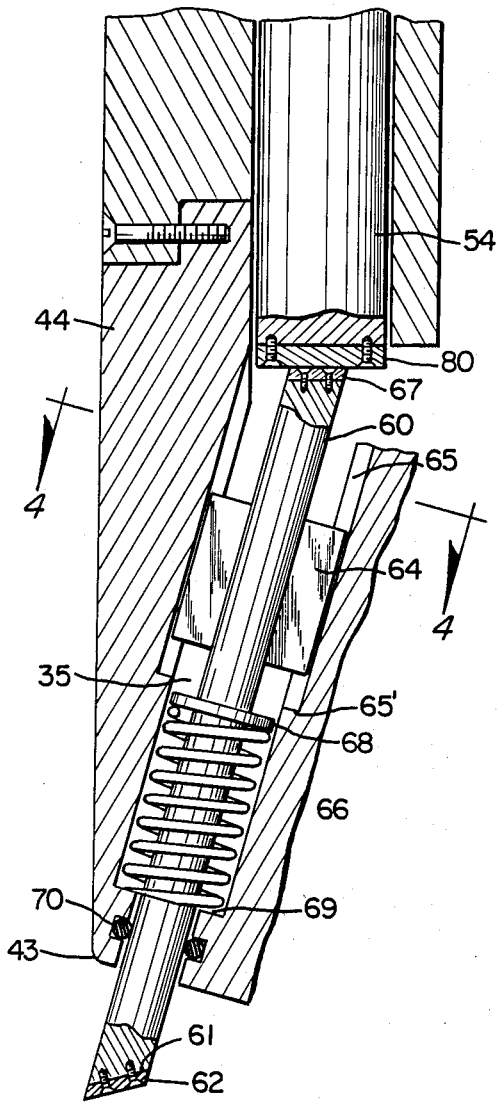
FIG. 3 is a sectional view illustrating in more detail one the movable teeth assemblies employed in the of the present invention.
Figure 4:
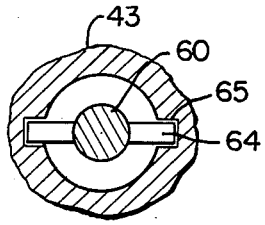
FIG. 4 is a cross-sectional view taken about lines 4—4 of FIG. 3.

Referring to FIGS. 2 to 4 and the construction and arrangement of each movable drilling tooth 36, a tooth shaft 60 of generally cylindrical configuration has a lower inclined end surface 61 to which is affixed a tooth plate 62, the plate 62 being made of a tungsten carbide or other wear resistant substance and which can be removed and replaced when worn or broken. The plate may be of a variety of shapes and sizes although preferably is of a generally elliptical configuration to conform to the inclined face of the lower end 61 and also may suitably vary in construction or composition according to the hardness or ductility of the substance to be penetrated. The shaft 60 has diametrically opposed tooth guides 64 which travel in radial grooves or longitudinal slots 65 in the tooth sleeve 37 so as to prevent each tooth from rotating and enable the tooth to be aligned in the desired orientation; also the guides limit the downward stroke of the tooth by virtue of the shoulder 65' at the lower end of the grooves or longitudinal slots 65.

A return spring 66 is mounted on the tooth shaft 60 between an upper retainer flange 68 and shoulder 69 and is mounted under compression so as to normally urge the tooth in a direction retracting it upwardly toward the activating piston 72. A pair of seals 70 are disposed at the lower end of the housing or sleeve 37 for each tooth. At the upper end of each tooth shaft 60 is a removable impact plate 67 of a substance similar to that employed on the tooth plate 62 and which is disposed at an angle with respect to the tooth shaft such that it is aligned with the axially extending lower end of the activating piston 54.

Figure 5:
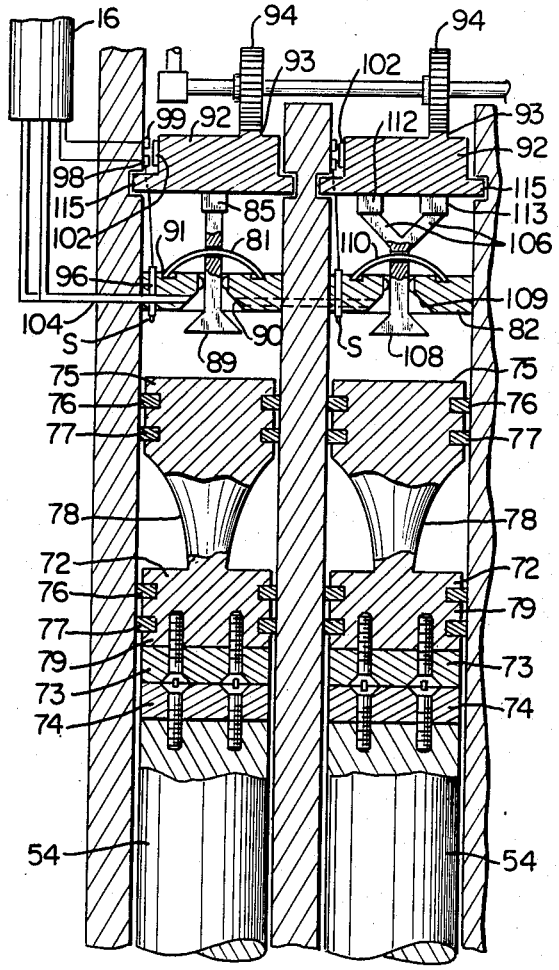
FIG. 5 is a fragmentary sectional view illustrating a portion of adjacent valve disks, combustion chambers and pistons employed in driving successive movable teeth, in accordance with the present invention.

Referring to FIGS. 2 and 5, a combustion operated drive assembly is located at the upper end of the body 34 and is comprised of combustion chambers in the form of the concentric annular or ring-like areas 50, 51, 52 aligned above the rows 40 to 43 of the tooth drilling assembly. Each piston 54 is in the form of a generally ring-like member disposed in each respective chamber area 50-52 and which when fired will impact a single ring, or portion of a ring, of the movable drilling teeth 36. In a manner to be described, the individual pistons 54 can be fired as often as necessary to effect optimum efficiency in driving the teeth 36, and the firing of the pistons 54 can be retarded or speeded up depending upon the nature of the material to be penetrated. Essentially, however, the pistons 54 and their activating mechanisms to be described are fired sequentially from the inner circle 40 outwardly to the outermost circle 43 in succession so that the drilling teeth 36 are sequentially driven from the center to the outside of the hole. In this way, the chipped off portions of the substance to be penetrated will tend to advance into the space evacuated by the chipping action of the teeth of the next inner adjacent ring. In particular, the inside/out chipping action has been found to improve the efficiency and speed at which the substances can be penetrated. Moreover, the impact force may be varied according to the amount of fuel or fuel/air mixture supplied thus enabling accurate control of the penetration rate in substances of different hardness. Again, referring to FIGS. 2, 3, and 5, each piston impact block 72 is aligned in end-to-end relation to the lower end of piston 54, and impact plates 73 and 74 are removably attached to the confronting end surfaces of the piston 54 and impact block 72, respectively. Each piston 54 may assume various different configurations and, as illustrated in FIG. 5, includes an upper body portion 75 with axially spaced sealing rings 76, 77 extending around the internal and external side surfaces for sealing with respect to the wall of the cylinder. Upper body portion 75 tapers downwardly through a narrow cross section intermediate portion 78 and terminates in enlarged lower body portion 79 with the impact plate 73 removably attached to the lower end of the body portion 79. Corresponding sealing rings 76, 77 are disposed in axially spaced relation to one another between the lower body 79 and wall surfaces of the cylinder. Each piston impact block 72 is of annular configuration and arranged to extend downwardly from the piston 54 to terminate in a lower impact plate 80 in confronting relation to upper impact plates 67 of each tooth assembly.

Figure 8:
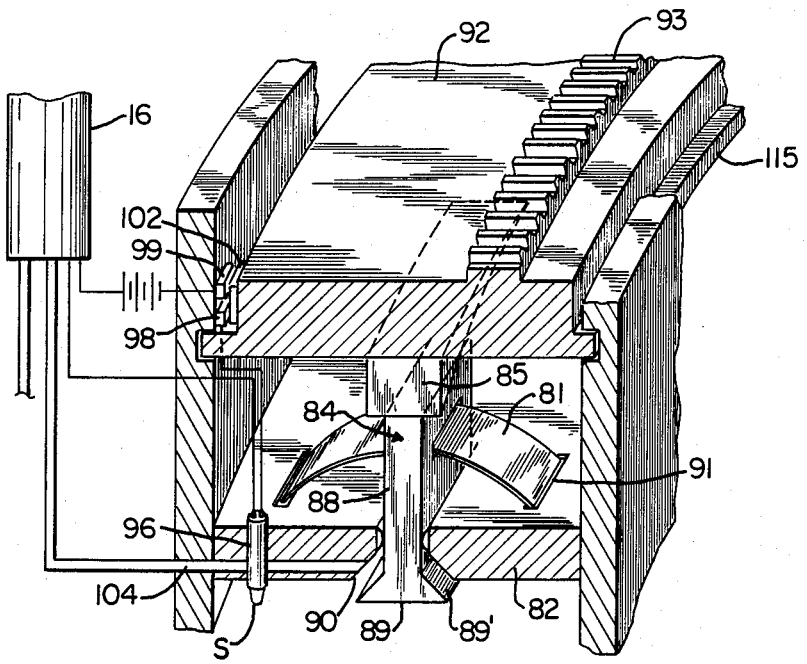
FIG. 8 is another perspective view illustrating a preferred form of intake valve with respect to a combustion chamber and cam track.

The upper end of each combustion chamber is closed by a cylinder wall 82, there being a series of fuel injection valves 84 and exhaust valves 86 located in each concentric ring or row of chambers 50 to 52. Each injection valve 84 includes a valve stem 88 provided with an enlarged valve member 89 movable toward and away from a valve seat 90, the valve member having a conical surface 89' to correspond with the valve seat and movable between an open position as shown in FIG. 5 and a closed position bearing against the seat 90. An arcuate leaf spring member 81 extends through the valve stem and is curved downwardly into press fit engagement with grooves 91 in the upper surface of the cylinder wall 82 to normally urge the valve upwardly in a direction forcing it into the closed position. The upper end of the valve stem 88 bears against a valve control cam 85 in the form of a downwardly projecting rib on a ring or annular cam member 92, and upwardly projecting gear teeth 93 intermesh with teeth on a gear 94. A spark plug S is mounted in the cylinder wall 82 adjacent to each injection valve and is electrically connected to a contact block 98 which is spaced beneath contact block 99 electrically connected by line 100 to power source 26. Another contact block 102 on the surface of the valve disk will complete the circuit between the contact blocks 99 and 98 when the cam 92 is rotated in a manner to be hereinafter described so as to generate a spark within the combustion chamber directly beneath the valve member 89. Fuel is injected into each chamber via a fuel injection port 104 which communicates via fuel line 24 with the fuel pump 22 at the surface. As illustrated in FIGS. 2 and 8, the fuel injection port 104 for the inner concentric chamber extends radially through the cylinder wall 80 into communication with the seat 90. Additional fuel injection ports or lines are directed radially outwardly through the combustion chambers and concentric rings 50, 51 and 52 to each of the concentrically located valves 84, as schematically illustrated in FIG. 6.

Figure 6:
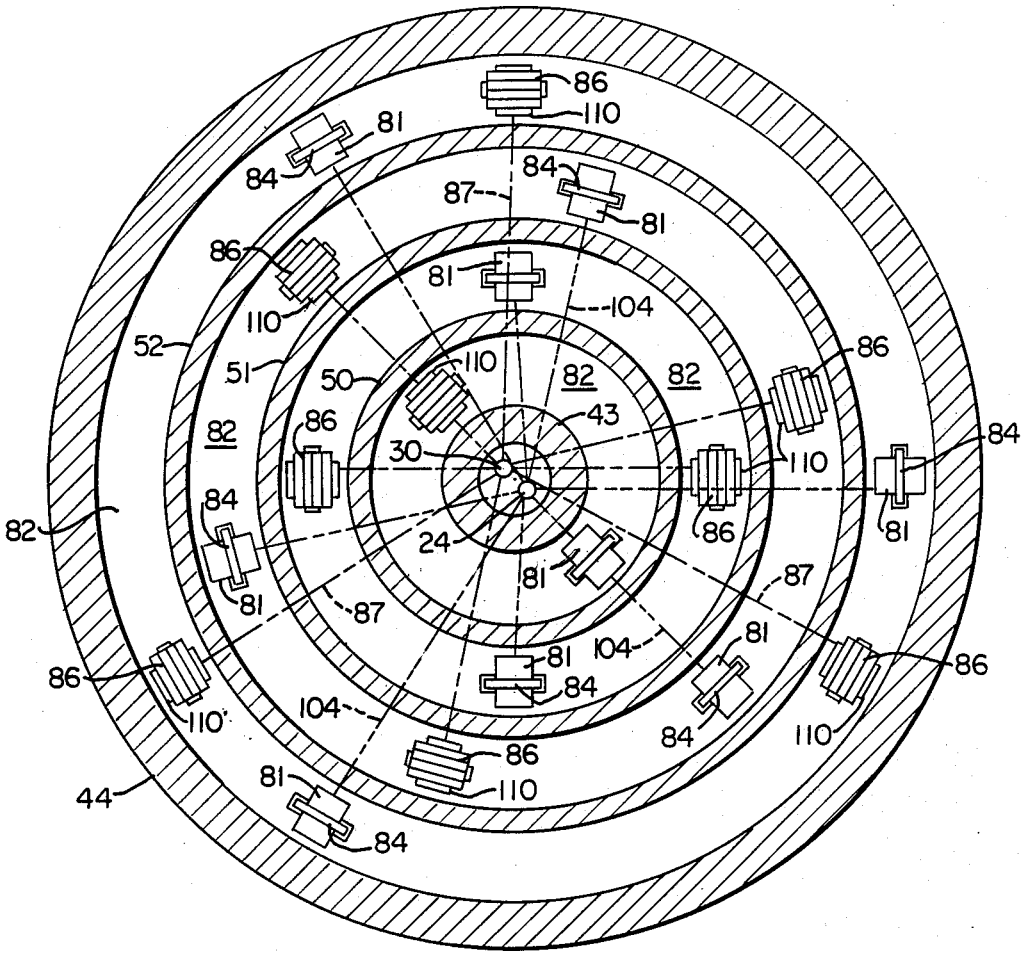
FIG. 6 is a cross-sectional view taken about lines 6—6 of FIG. 2 and schematically illustrating the fuel intake and exhaust lines.
Figure 7:
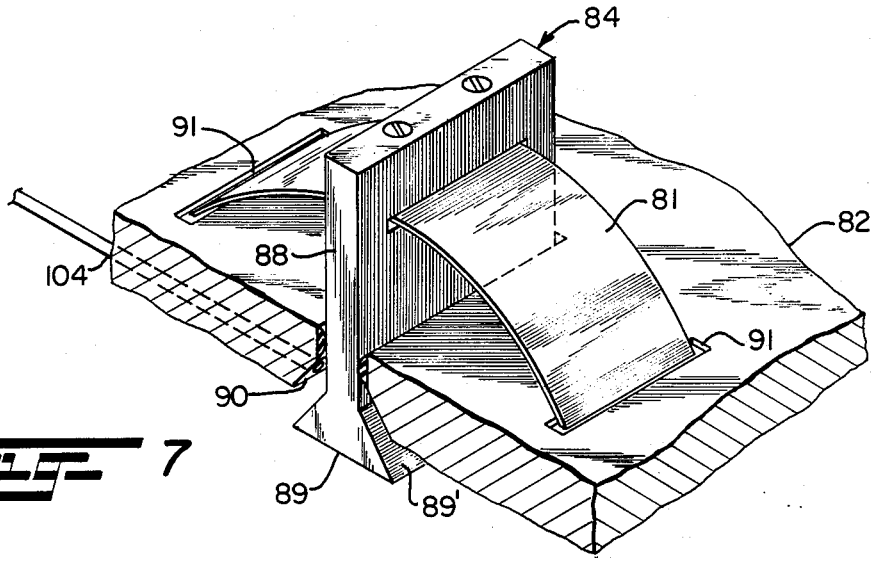
FIG. 7 is a perspective view of a preferred form of intake valve.
Figure 9:
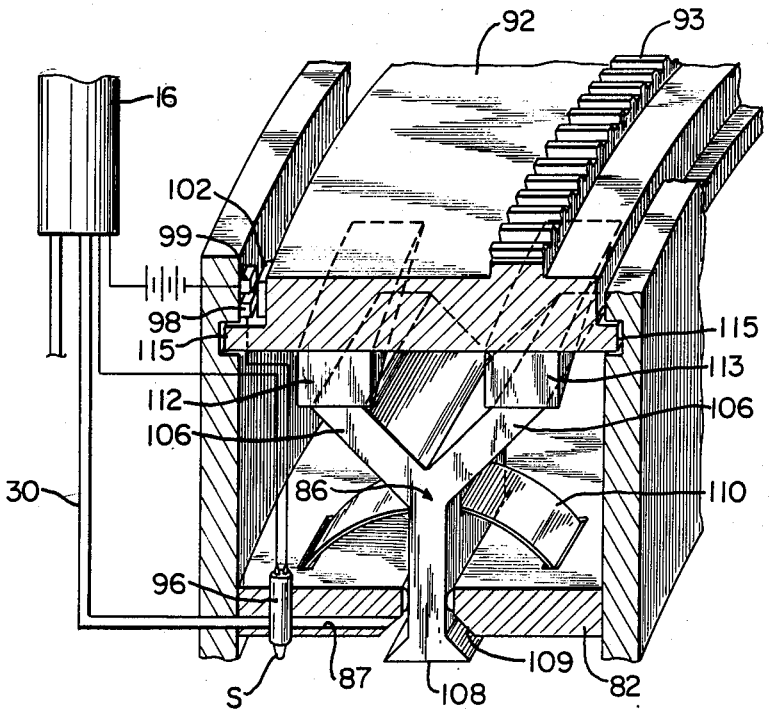
FIG. 9 illustrates a preferred form of exhaust valve and cam track.

Referring to the exhaust valve 86, although illustrated in side-by-side relation to an injection valve 84 in adjacent combustion chambers in FIG. 5, as further represented in FIG. 6, the exhaust valves 86 alternate with the injection valves 84 in each row. The valves 86 are spaced such that upon ignition of fuel in the chamber the exhaust valves 86 are advanced by a drive gear 94 to an open position in order to exhaust the combustion gases via ports 87 into line 30 after each ignition cycle and thereafter are returned to a closed position in preparation for the next ignition or firing sequence. As seen from FIG. 5, each exhaust valve 86 is of generally "Y" shaped configuration having upper bifurcated ends 106 and a lower valve member 108 having a conical surface normally urged against valve seat 109 in the cylinder wall 80. An arcuate leaf spring 110 is mounted with respect to the exhaust valve in the same manner as the leaf spring 81 for the injection valve and causes the valve stem to be normally urged in a direction closing the valve by urging the valve 108 into engagement with the seat 109. The cam ring 92 includes downwardly projecting ribs or cams 112 and 113 which are radially spaced with respect to one another, as best seen from FIG. 9. The ribs 112, 113 incline in a circumferential direction so as to form ramps of gradually increasing depth causing the exhaust valve 86 to be moved gradually into an open position and then gradually returned to a closed position during and after each firing sequence. Similarly, as illustrated in FIG. 8, the single rib or cam 85 is a ramp of generally increasing depth which is located centrally of the ring 92 and, as the ring 92 is rotated by the drive gear 94, will move into engagement with an injection valve stem 84 to overcome the urging of the leaf spring 81 and open the valve for introduction of fuel via the fuel line 24 as a preliminary to each firing sequence. The valve then returns to the closed position during each firing cycle under the urging of the leaf spring 81. The exhaust line 30 permits removal of the spent gases when uncovered by an exhaust valve 86 at the end of each firing sequence. Specifically, exhaust ports 87 radiate outwardly from the exhaust line through the combustion chambers, as illustrated in FIG. 6, for extension through a cylinder wall 82 into communication with a valve seat 109. Bearings 115 are disposed between the sides of the valve rings 92 and cylinder walls. Preferably the drive gear 94 is driven by a turbo electric motor M which is energized by the electrical lines 100 from the power source 26.

In operation, drilling fluid is circulated in a conventional manner through bore 14 and lower end 14' along the cutting face. The drilling fluid in a well known manner operates as a coolant as well as to aid in circulating and removing chipped particles upwardly for removal into a separate collection basin or reservoir at the surface. Compressed air is delivered by compressor 28 via circulating line 29 and into the combustion chambers via ports 104. Fuel is injected via lines 24 from the fuel tank 20 through fuel injection ports 104 into each of the combustion chambers. The rheostat control 27 is operative to regulate the downhole motor M for driving the cam rings 92 at a predetermined rate of speed. When the cam rings rotate, the contact block 102 completes the circuit between the outer contact blocks 98 and 99 causing a spark which fires each chamber in turn. The injection valve 84 is depressed as a preliminary to ignition to inject fuel into the chamber; and as the cam ring 92 rotates further the valve 84 is caused to retract into a closed position and electrical contact is made to ignite the fuel/air mixture. When ignited, the pressure buildup in the combustion chamber drives each piston 78 in succession downwardly against impact blocks 54 so as to impart a driving force to the upper impact plate 71 on each tooth drilling assembly in that circle. The firing frequency is controlled by the speed of rotation of the cam rings 92 when the motor M is energized, and the power of the stroke is regulated for the most part by the fuel injection pressure as determined by the fuel pump 22.

At the conclusion of the firing sequence, the cam rings 92 are advanced into engagement with the exhaust valves 86 to cause the valves to be depressed or opened and permit the spent gases to be exhausted as described. As each chamber is fired and the cam ring 92 is rotated, ribs 112 and 113 on the cam disk 92 move into a position to open the exhaust valve 86. Simultaneously, tooth springs 66 return the impacted teeth 62 to their original positions, thereby forcing the pistons upward into firing position causing exhaust gases to be expelled through the open exhaust valve 86. The firing sequence is established such that the drilling or cutting action proceeds from the inner row outwardly to the outermost row so that each row in succession is caused to fire and exert a penetrating action via the teeth. This sequential firing is created simply by appropriate arrangement of contact points 98, 99 and 100 on the cylinder walls and cam rings as illustrated.

As noted, the teeth 62 are of generally circular configuration although oval or other shapes of teeth are possible as long as they can be sealed to prevent the entry of drilling fluid and debris into the individual guideways for the tooth drilling assembly. It should be further noted that the fan-shaped arrangement of the teeth within the tooth housings are such that the inner rows are progressively lower than the outer rows so that the overall bit housing 34 is of generally convex configuration along the bottom. In the illustrative embodiment shown in FIG. 6, the number of injection/exhaust valves consists of one pair for each piston segment. The inner chamber ring may be one continuous ring, and the next ring comprised of two semi-circular chambers; the next outer concentric ring may be comprised of three chambers; and the next and subsequent rings may be comprised of three chamber sections. The number of separate firing chambers generally will depend on the hardness or ductility of material to be penetrated, and in certain cases can employ single chambers in each ring or annulus depending upon the hardness of material. Further, it is apparent that the number of teeth in a given housing may be varied as well as the particular angular disposition of the teeth 62. The return springs 60 as described exert sufficient force to retract the teeth at the completion of each firing sequence although it will be apparent that compressed air may be employed as a supplement to the return springs. By way of illustration, each ring of teeth may be fired every four seconds with the rate of rotation of each ring being on the order of one to two revolutions per minute. Rate of penetration can be increased with more rapid rotation but the main factor is the rate of the stroke.

It is therefore to be understood that various modifications and changes may be made in the specific construction and arrangement of parts as well as composition of materials comprising the alternate forms of the present invention without departing from the spirit and scope thereof as defined by the appended claims.

We claim:

1. A percussion drill bit for drilling subterranean bore holes comprising:

a drill bit housing mounted at a lower end of a drill string, said housing provided with a central opening therethrough;

a plurality of drill rods concentrically arranged to diverge downwardly through said housing, each said rod having an impact tooth at a lower end of said rod projecting downwardly and away from said housing, and means mounting said drill rod for slidable lengthwise reciprocal movement along the respective longitudinal axes of said drill rods;

a series of combustion chambers arranged in concentric relation to one another above said drill rod, each chamber including at least one fuel intake valve and one exhaust valve;

means for delivering a combustible fuel mixture into each of said combustion chambers, and ignition means for igniting said mixture when it is introduced into each said chamber; and sequential control means for sequentially opening and closing each of said intake and exhaust valves in each chamber and having firing means correlated with the opening of said intake valves to activate said ignition means associated with each intake valve in coordination with the opening of each said intake valve whereby to sequentially advance said drill rods downwardly into said subterranean formation in response to activation of said ignition means.

2. A drill bit according to claim 1, including return spring means associated with each of said drill rods for retracting each of said drill rods upwardly at the end of each firing.

3. A drill bit according to claim 1, including impact blocks interposed between each of said drill rods and a combustion chamber.

4. A drill bit according to claim 1, said sequential control means and said firing means being correlated to sequentially activate said drill rods successively from the innermost to outermost concentric rows.

5. A drill bit according to claim 1, each of said combustion chambers being of annular configuration, and impact blocks slidably disposed in sealed relation to lower ends of said combustion chambers whereby firing of a fuel mixture in each chamber imparts a downward force against said impact blocks and drill rods associated with each chamber.

6. A drill bit according to claim 1, each of said drill rods being of generally cylindrical cross-section and having a tapered lower end, each impact tooth releasably affixed to said tapered lower end of each of said drill rods.

7. A drill bit according to claim 6, each of said impact teeth being of generally oval-shaped configuration.

8. A drill bit according to claim 7, each drill rod having wing guides inserted in longitudinally extending slots of a bore, said drill rod bores arranged in concentric rows, said bores in each row arranged on a different axis.

9. A drill bit according to claim 8, said bores in said inner row converging downwardly and inwardly toward the longitudinal axis of said housing, and said drill rod bores in each succeeding row progressively outwardly from said inner row being arranged on axes which diverge downwardly and outwardly away from the central axis of said housing, the angle of divergence progressively increasing in each successive row.

10. A drill bit according to claim 9, said lower end of said housing being of generally convex configuration and tapering away from said central axis of said housing.

11. A drill bit according to claim 1, each said intake and exhaust valve including an upwardly directed valve stem member, an annular cam member mounted for rotation above each of said combustion chambers, each cam member having downwardly directed cams engageable with said intake and exhaust valve members to successively control opening of said valve members for ignition and discharge of said combustion mixture from each combustion chamber.

12. A drill bit according to claim 11, said cams on each of said cam members being so arranged as to successively fire said intake valves during each firing cycle progressing in radial outward direction from said inner row to said outer row whereby to cause said impact teeth to penetrate said formation in a radially outward direction as said drill string is being rotated.

13. In a percussion drill bit apparatus for earth boring into subterranean formations wherein a drill bit housing is mounted at a lower end of a drill string, the improvement comprising:

a plurality of drill rods arranged for downward extension in a plurality of concentric rows through individual drill rod bores in the lower end of said housing including impact teeth at lower ends of said drill rods, said concentric rows of said drill rods vertically offset with respect to one another so that at least one inner row of said drill rods will extend to a greater depth into said formation than outer rows of said drill rods, and at least one outer row of said drill rods diverging downwardly and outwardly through said lower end of said housing, and means mounting said drill rods for slidable lengthwise reciprocal movement along respective longitudinal axes of said drill rods; and drill rod drive means for sequentially imparting a percussive force to each said concentric row of said drill rods whereby to sequentially activate said drill rods and associated impact teeth successively from the innermost to outermost concentric rows to penetrate said formation.

14. In a percussion drill bit apparatus according to claim 13, said concentric rows of said drill rods arranged for downward extension through said lower end of said housing at different selected angles of attack.

15. In a percussion drill bit apparatus according to claim 14, said inner concentric row of said drill rods converging downwardly and inwardly toward a central axis of said drill bit housing.

16. In a percussion drill bit apparatus according to claim 14, said outer concentric rows of said drill rods diverging downwardly and outwardly away from a central axis of said drill bit housing.

17. In a percussion drill bit apparatus according to claim 13, including impact blocks positioned above each of said drill rods and piston members mounted above said impact blocks for imparting a downward percussive force to each of said drill rods.

18. In a percussion drill bit apparatus according to claim 17, said drive means including annular combustion chambers associated with each of said concentric rows of said drill rods, said piston rods and associated impact blocks mounted for downward extension from each of said combustion chambers.

19. In a percussion drill bit apparatus according to claim 18, said drive means including means for delivering a combustible fuel mixture into each of said combustion chambers, and ignition means for igniting said fuel mixture when it is introduced into each said combustion chamber.

20. In a percussion drill bit apparatus according to claim 19, including return spring means associated with each said drill rod to bias each of said drill rods upwardly into a retracted position within said housing.

* * * * *